US007606523B2

(12) United States Patent
Kubo

(10) Patent No.: US 7,606,523 B2
(45) Date of Patent: Oct. 20, 2009

(54) APPARATUS FOR IMAGE FORMATION

(75) Inventor: Takashi Kubo, Kizugawa (JP)

(73) Assignee: Sharp Kabushiki Kaisha, Osaka (JP)

( * ) Notice: Subject to any disclaimer, the term of this patent is extended or adjusted under 35 U.S.C. 154(b) by 178 days.

(21) Appl. No.: 11/875,357

(22) Filed: Oct. 19, 2007

(65) Prior Publication Data

US 2008/0095547 A1 Apr. 24, 2008

(30) Foreign Application Priority Data

Oct. 24, 2006 (JP) ..... 2006-288374

(51) Int. Cl.
*G03G 21/12* (2006.01)

(52) U.S. Cl. ..... 399/360

(58) Field of Classification Search ..... 399/107, 399/119, 120, 343, 358, 360
See application file for complete search history.

(56) References Cited

U.S. PATENT DOCUMENTS 6,937,838 B2 * 8/2005 Ishii et al. ..... 399/358
6,952,554 B2 * 10/2005 Ahn et al. ..... 399/358
7,149,467 B2 * 12/2006 Stickler et al. ..... 399/358
7,239,841 B2 * 7/2007 Jeong et al. ..... 399/358

FOREIGN PATENT DOCUMENTS

JP 7-32667 6/1995
JP 2001-324905 11/2001

* cited by examiner

*Primary Examiner*—Hoan H Tran
(74) *Attorney, Agent, or Firm*—Nixon & Vanderhye, P.C.

(57) ABSTRACT

An apparatus for image formation includes a slider, rotatable members, elastic members, and a waste toner box. The slider is supported by the main body of the apparatus and can reciprocate in the outward direction from the inside of the body to one side of the body and the inward direction opposite to the outward direction. The rotatable members are arranged in the outward and inward directions over the slider. Each of the elastic members biases one of the rotatable members upward relative to the slider. The rotatable members support the waste toner box, which has an inlet for connection to the bottom of the outlet. The box inlet is formed at the end of the waste toner box that is upstream in the outward direction. The elastic member most upstream of all the elastic members in the outward direction is the greatest in biasing force of all the elastic members.

5 Claims, 8 Drawing Sheets

APPARATUS FOR IMAGE FORMATION

CROSS REFERENCE

This Nonprovisional application claims priority under 35 U.S.C. §119(a) on Patent Application No. 2006-288374 filed in Japan on Oct. 24, 2006, the entire contents of which are hereby incorporated by reference.

BACKGROUND OF THE INVENTION

The present invention relates to an apparatus for image formation by a process of electrophotographic image formation. The apparatus is fitted with a removable box for containing recovered waste toner.

An apparatus for electrophotographic image formation forms an image on a recording medium through a charging step, an exposure step, a developing step, a transfer step, and a fixing step. In the developing step, the apparatus converts an electrostatic latent image on its electrostatic latent image carrier into a toner image, which is visible. In the transfer step, the apparatus transfers the toner image to a recording medium. After the transfer step, an amount of toner remains on the image carrier. The remaining toner is removed from the image carrier by the cleaning unit of the apparatus and then recovered as waste toner into the waste toner box of the apparatus.

The waste toner box of a conventional apparatus for image formation occupies a small volume in the apparatus and is smaller in capacity than 1 kg. Accordingly, a user can easily take the waste toner box out of the apparatus when the box is full of waste toner.

In recent years, as disclosed in JP-2001-324905A, the processing speed of apparatus for image formation has been higher, so that the amount of waste toner discharged from it per unit time has increased. As a result, the capacity of the waste toner boxes of the apparatus has been increased greatly to about 10 kg. This has restrained the shortening of the waste toner box replacement cycles.

The increased capacity of a waste toner box results in increased weight of the box full of waste toner, so that it is not easy to take out the box in order to replace it. If it is not easy to take out the waste toner box, it may fall down when taken out. This may scatter the toner in the waste toner box, further lowering the workability during the replacement of the box.

SUMMARY OF THE INVENTION

The object of the present invention is to provide an apparatus for image formation improved in the workability during the replacement of the waste toner box of the apparatus.

An apparatus for image formation according to the present invention includes a slider, rotatable members, elastic members, and a waste toner box. The slider is supported by the main body of the apparatus and can reciprocate in the outward direction from the inside of the body to one side of the body and the inward direction opposite to the outward direction. The rotatable members are arranged in the outward and inward directions over the slider. Each of the elastic members biases one of the rotatable members upward relative to the slider. The rotatable members support the waste toner box, which has an inlet for connection to the bottom of the outlet. The box inlet is formed at the end of the waste toner box that is upstream in the outward direction. The elastic member most upstream of all the elastic members in the outward direction is the greatest in biasing force of all the elastic members.

DETAILED DESCRIPTION OF THE INVENTION

Figure 1:
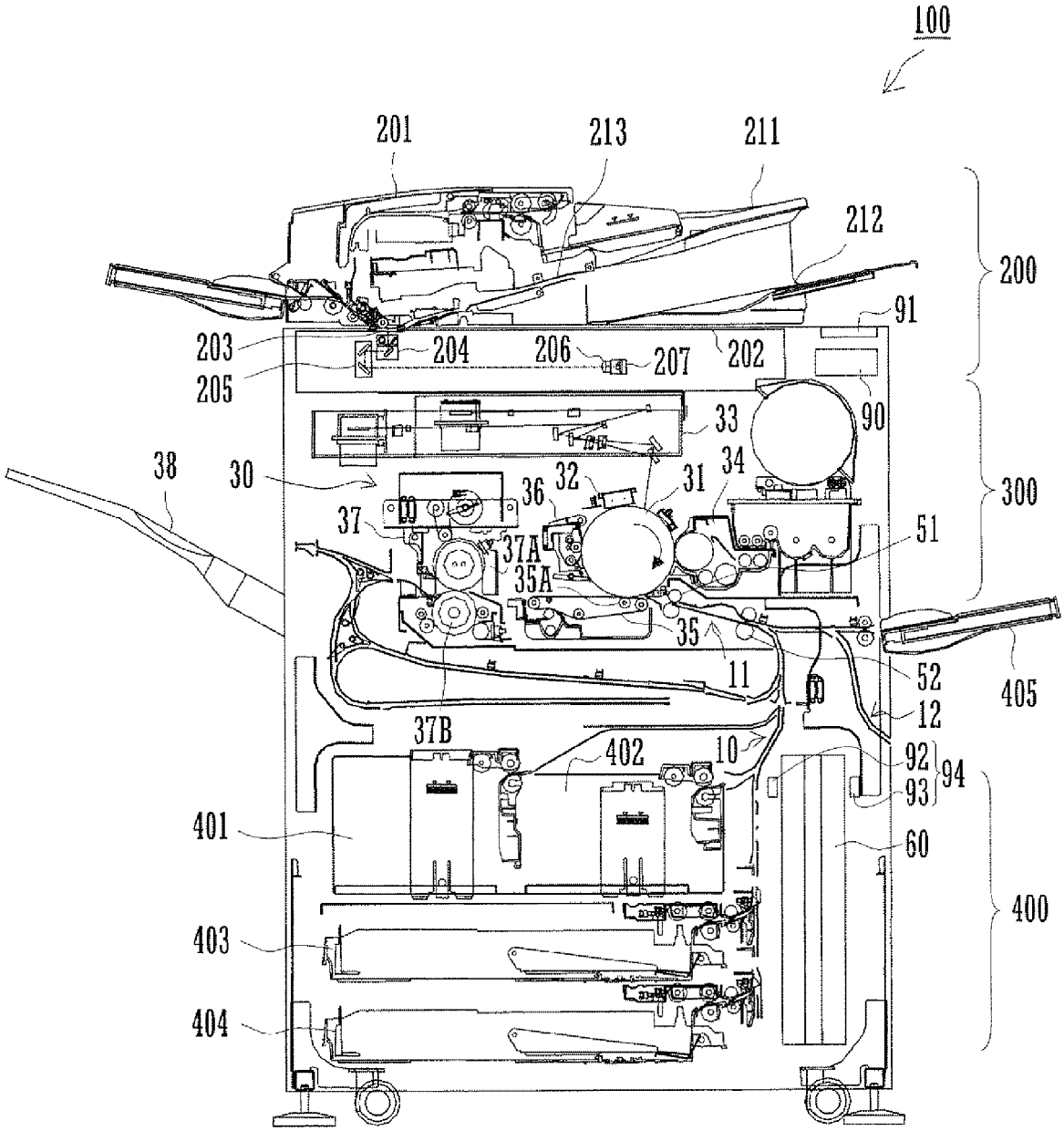
FIG. 1 is a sectional front view of an apparatus for image formation embodying the present invention.

The best mode of carrying out the present invention will be described below with reference to the accompanying drawings. FIG. 1 schematically shows the structure of an apparatus for image formation 100 embodying the present invention. The apparatus 100 includes an image reading unit 200, an image recording unit 300, and a feed unit 400.

The image reading unit 200 includes an automatic document feeder 201, a first document platform 202, a second document platform 203, a first mirror base 204, a second mirror base 205, a lens 206, and a charge coupled device (CCD) 207.

The document feeder 201 has a feed passage 213, which leads from a document tray 211 via the second document platform 203 to an outlet tray 212. The document feeder 201 feeds documents one after one into the feed passage 213. The rear edge of the document feeder 201 is so supported that this feeder can pivotably cover the upper side of the first document platform 202. By raising the front edge of the document feeder 201 so as to expose the upper side of the first document platform 202, it is possible to place a document manually on this platform.

The document platforms 202 and 203 are a hard glass plate.

The mirror bases 204 and 205 can move horizontally under the document platforms 202 and 203. The speed at which the second mirror base 205 moves is ½ of the speed at which the first mirror base 204 moves. The first mirror base 204 carries a light source and a first mirror. The second mirror base 205 carries a second mirror and a third mirror.

The image on a document being fed by the document feeder 201 is read with the first mirror base 204 stopping under the second document platform 203. The light source on the first mirror base 204 under the second document platform 203 radiates light to the front side of the document passing over this platform. The light reflected by this side of the document is then reflected by the first mirror on the first mirror base 204 toward the second mirror base 205.

The image on a document placed on the first document platform 202 is read with the mirror bases 204 and 205 moving horizontally under this platform. The light source on the first mirror base 204 moving under the first document platform 202 radiates light to the front side of the document on this platform. The light reelected by this side of the document is then reflected by the first mirror on the first mirror base 204 toward the second mirror base 205.

Whether the document feeder 201 is used or not, the light reflected by the front side of the document is incident on the CCD 207 via the lens 206 by means of the second and third mirrors on the second mirror base 205, with the optical path length kept constant.

The CCD 207 outputs an electric signal based on the quantity of light reflected by the front side of the document. The electric signal is input as image data into the image forming unit 300.

The image recording unit 300 includes an image former 30 consisting of a photoconductor drum 31, a charging unit 32, an exposure unit 33, a developing unit 34, a transfer belt 35, a cleaning unit 36, and a fixing unit 37.

The photoconductor drum 31 corresponds to the image carrier of the present invention, has a photosensitive layer formed on its cylindrical surface, and rotates clockwise in FIG. 1. The charging unit 32 charges the drum surface to a uniform electric potential. The charging unit 32 may be either a non-contact type charging unit with a charger or a contact type charging unit with a roller or a brush.

The exposure unit 33, which may be a laser scanning unit, scans the cylindrical surface of the photoconductor drum 31 axially of the drum by means of a polygon mirror with a laser beam modulated with the image data. Photoconduction in the photosensitive layer of the drum 31 forms an electrostatic latent image on the scanned drum surface. The exposure unit 33 might be replaced by an exposure unit having an array of ELs, LEDs, or other light emitting devices.

The developing unit 34 supplies the cylindrical surface of the photoconductor drum 31 with toner so as to convert the electrostatic latent image into a toner image, which is visible.

The transfer belt 35 forms a loop around rollers under the photoconductor drum 31 and has an electric resistance between about $1\times10^{9}$ and $1\times10^{13}$ Ω·cm. A transfer roller 35A is supported inside the transfer belt 35 and biased to bring it into compressive contact with the cylindrical surface of the photoconductor drum 31. A transfer voltage is applied to the transfer roller 35A. The toner image on the drum 31 is transferred to a sheet of paper passing between the drum and the transfer belt 35.

The cleaning unit 36 removes the toner remaining on the portion of the drum surface from which the toner image has been transferred to the sheet.

The image recording unit 300 also includes a waste toner box 60. The toner removed from the cylindrical surface of the photoconductor drum 31 is conveyed to an outlet 39 (FIGS. 2 and 4-7) by a waste toner conveying screw (not shown). The conveyed toner flows out through the outlet 39 and is recovered as waste toner into the box 60.

The waste toner box 60 is so shaped as to be taken out forward of the apparatus 100. When the box 60 is full of waste toner, it is replaced with an empty waste toner box of the same shape.

It may be detected in the following way that the waste toner box 60 is full. The box 60 has a pair of transparent windows (not shown) each formed in one of its side walls. The transparent windows are positioned at the top of the waste toner filling the box 60. The apparatus 100 is fitted with a light sensor 94, which includes a light emitting-device 92 and a light-receiving device 93. Each of these devices 92 and 93 is positioned outside one of the transparent windows. When the box 60 is not full, the light emitted from the light-emitting device 92 penetrates through the transparent windows and is received by the light-receiving device 93. If the light-receiving device 93 does not receive the light from the light-emitting device 92, the light sensor 94 senses the box 60 being full and then outputs the sensing result to a control unit 90. When the sensing result is input to the control unit 90, this unit warns on a display 91 that the box 60 is full.

The fixing unit 37 includes a heating roller 37A and a pressing roller 37B. The heating roller 37A has a heater fitted in it for heating it to a temperature at which the toner on this roller can melt. The pressing roller 37B is biased into compressive contact with the heating roller 37A under a preset pressure. While the sheet with the toner image on it is passing between these rollers 37A and 37B, the fixing unit 37 heats and presses the sheet so as to fix the image fast on the sheet. After passing through the fixing unit 37, the sheet is conveyed to an outlet tray 38, which is fitted on the right (left in FIG. 1) side of the apparatus 100.

The feed unit 400 includes feed cassettes 401-404 and a manual feed tray 405. Each of the feed cassettes 401-404 holds sheets of paper of a size. The manual feed tray 405 supports a sheet of paper of size or quality for less frequent use.

The feed unit 400 feeds sheets of paper one after one from one of the feed cassettes 401-404 or the manual feed tray 405. The sheets from the feed unit 400 are then fed to the image former 30 through feed passages 10 and 11 by a pair of feed rollers 52, which is supported on the feed passage 11.

A pair of registration rollers 51 is supported on the feed passage 11 downstream from the feed rollers 52. The axes of the rollers 51 and 52 are perpendicular to the feed direction in which these rollers feed a sheet of paper. With the registration rollers 51 pausing, the feed rollers 52 feed a sheet of paper, so that the leading end of the sheet is thrust against the nip between the registration rollers 51. If the sheet deviates angularly from the feed direction, the sheet end thrusting corrects the deviation.

The registration rollers 51 start rotating to feed the sheet to the position between the photoconductor drum 31 and the transfer belt 35 at such a timing that the leading end of the sheet registers with the leading end of a toner image formed on the drum 31. After the toner image is transferred and fixed to the sheet in the ways described already, the sheet is delivered to the outlet tray 38.

A large capacity cassette for holding a large number of sheets of paper can be positioned under the manual feed tray 405 on the left (right in FIG. 1) side of the apparatus 100. A sheet of paper fed from the large capacity cassette is then fed to the image former 30 through a feed passage 12.

Figure 2:
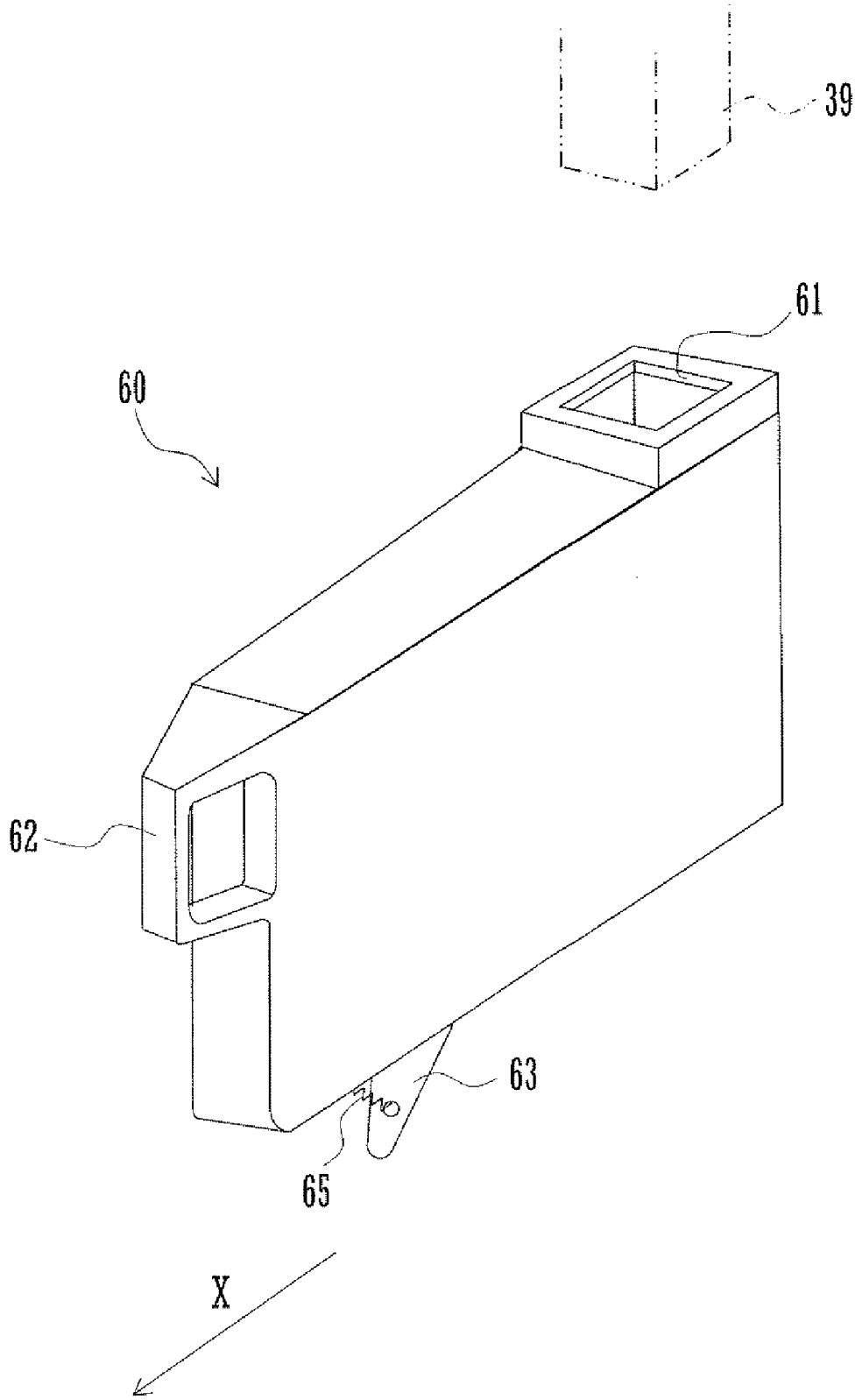
FIG. 2 is a perspective view of the waste toner box of the apparatus.

With reference to FIG. 2, the waste toner box 60 is thin, high, and long. The box 60 may be 200 mm thick, 400 mm high, and 500 mm long.

Figure 3A:
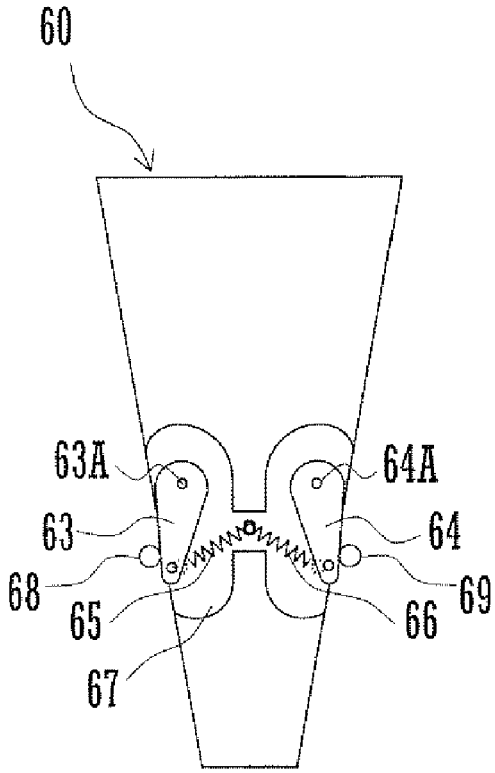
FIG. 3A is a bottom view of the waste toner box, showing its stabilizing members in their retracted positions.
Figure 3B:
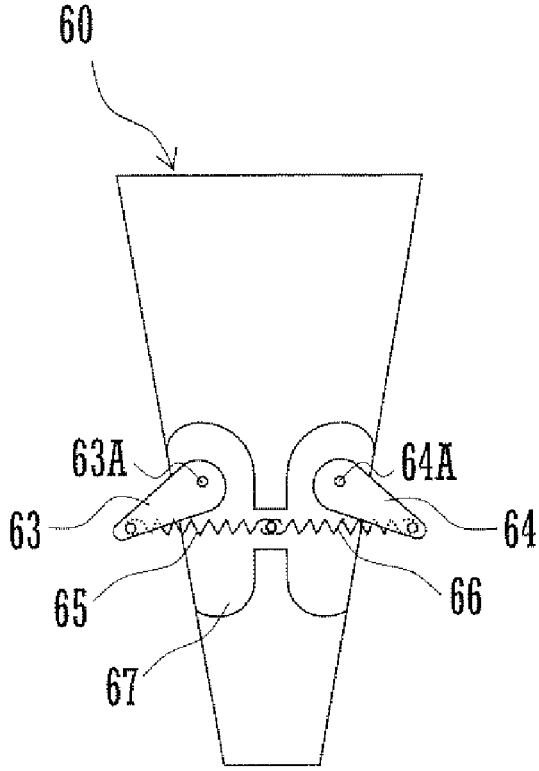
FIG. 3B is a bottom view of the waste toner box, showing its stabilizing members in their protruded positions.

The waste toner box 60 has an inlet 61 and a handle 62. With reference to FIGS. 3A and 3B, the box 60 is fitted with a pair of stabilizing members 63 and 64 and a pair of springs 65 and 66. The springs 65 and 66 correspond to the bias members of the present invention.

The box inlet 61 is formed at the top of the waste toner box 60, and at the end of the box that is upstream in the outward direction X from the inside of the main body of the apparatus 100 to the front side of the body. The inlet 61 protrudes upward and is connected to the bottom of the outlet 39. The connection fixes the position of the box 60. The height of the inlet 61 is great enough to keep it connected to the outlet 39 even if the box 60 shifts slightly downward as it gets full.

The box handle 62 is formed near the top of the waste toner box 60, and at the end of the box that is downstream in the outward direction X.

The stabilizing members 63 and 64 are supported on the bottom of the waste toner box 60. Each of the stabilizing members 63 and 64 can pivot between its retracted position shown in FIG. 3A, where it is retracted substantially within the box bottom, and its protruded position shown in FIG. 3B, where it is protruded perpendicularly to the outward direction X.

The stabilizing members 63 and 64 pivot in symmetry with each other on vertical axes 63A and 64A respectively and protrude away from each other. The springs 65 and 66 bias the stabilizing members 63 and 64 respectively toward the protruded positions.

The apparatus 100 has a pair of protrusions 68 and 69 formed on the upper side of its bottom. The protrusions 68 and 69 correspond to the shifting members of the present invention. When the waste toner box 60 is put into the apparatus 100, the stabilizing members 63 and 64 in the protruded positions come into contact with the protrusions 68 and 69 respectively so as to pivot to the retracted positions.

The waste toner box 60 has a recess 67 formed on the under side of its bottom. The stabilizing members 63 and 64 are positioned in the recess 67. The recess 67 is deep enough for the stabilizing members 63 and 64 and springs 65 and 66 to shift smoothly in it without protruding downward from the bottom of the box 60.

The waste toner box 60 is thinner in the outward direction X, that is, toward the front side of the apparatus 100. This enables easy maintenance, for example, when the feed passage 10 is jammed.

The inlet 61 is square but might be circular. If the inlet 61 were circular, it would be possible to shift the end of the waste toner box 60 that is downstream in the outward direction X to the left (right in FIG. 1) around the inlet 61. This would widen the space between the box 60 and the feed passage 10, so that this passage would be easier to maintain.

Figure 4:
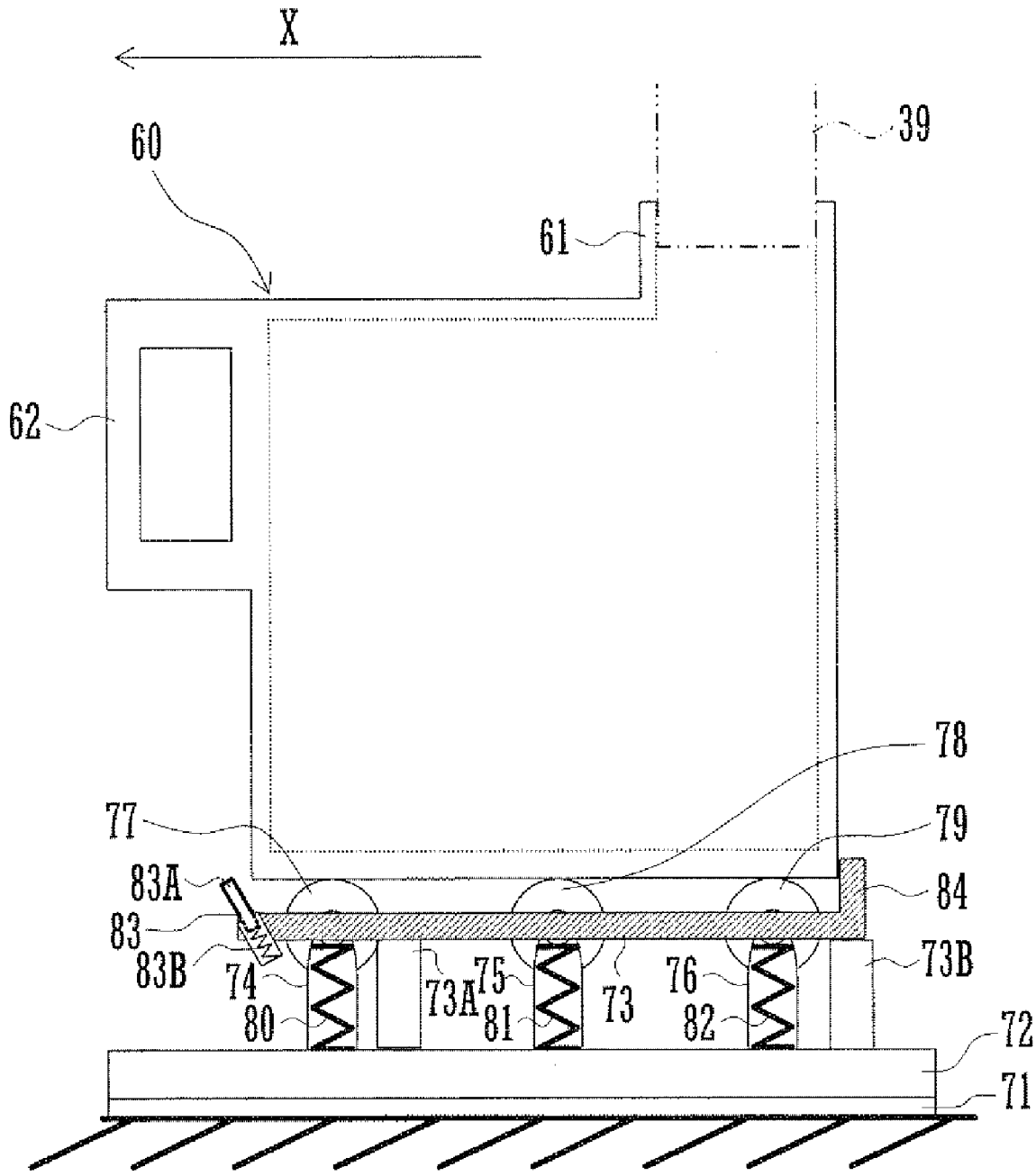
FIG. 4 is a sectional side view of part of the apparatus, showing the waste toner box being empty.
Figure 5:
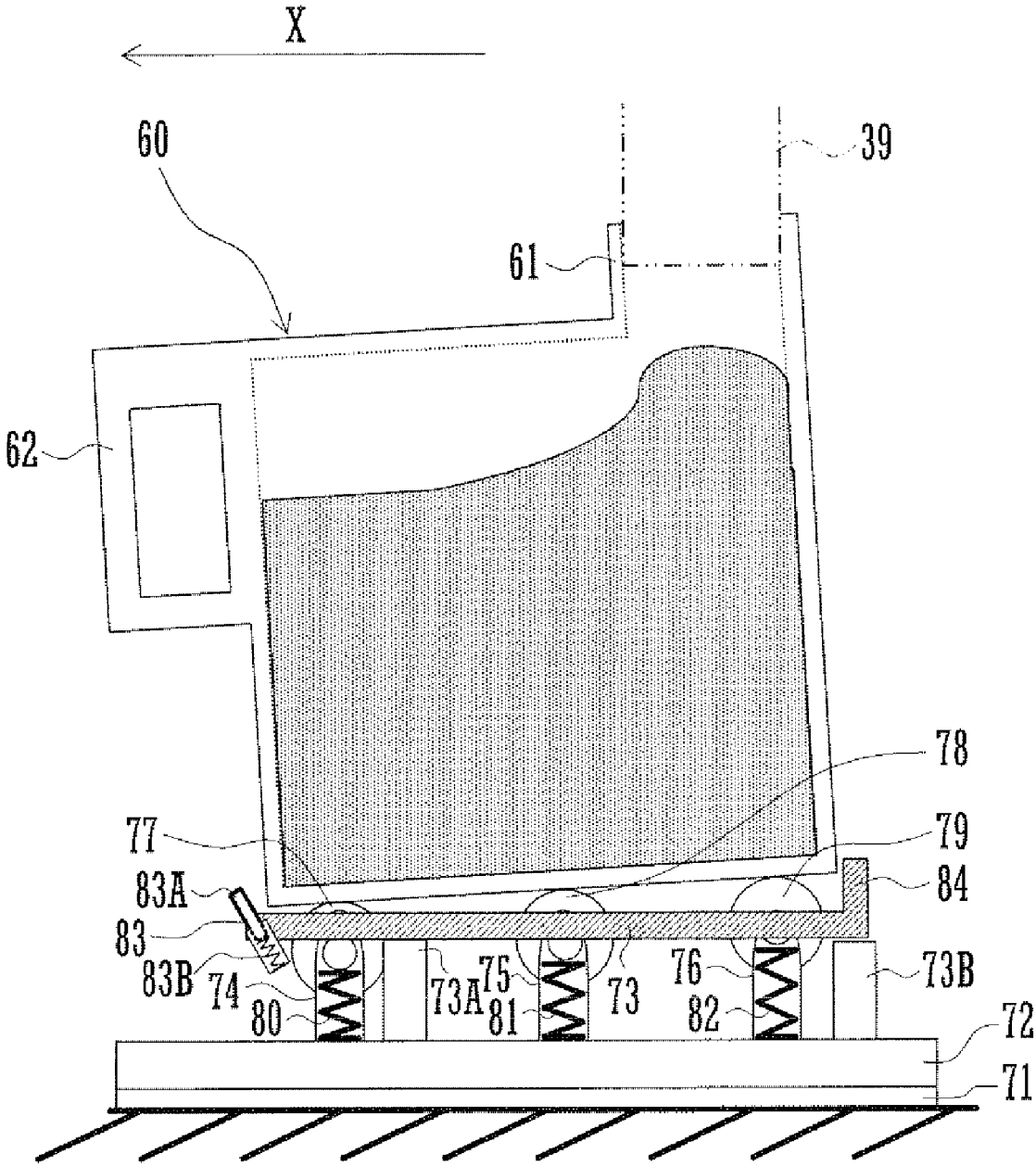
FIG. 5 is a sectional side view of part of the apparatus, showing the waste toner box being full.

FIGS. 4 and 5 show the waste toner box 60 being empty and full respectively.

The apparatus 100 is fitted with a rail 71, a slider 72, a plate 73, roller holders 74-76, rollers 77-79, and springs 80-82. The rollers 77-79 correspond to the rotatable members of the present invention. The springs 80-82 correspond to the elastic members of the invention.

The rail 71 is laid on a frame of the apparatus 100 along the outward direction X. The slider 72 is supported on the rail 71 slidably along it. The rail 71 and slider 72 take the form of a slide rail.

The plate 73 is supported over the slider 72 by a pair of plate supports 73A and 73B, which stands on the slider 72.

The roller holders 74-76 stand on the slider 72 and are spaced along the outward direction X. The shafts of the rollers 77-79 are held vertically movably by upper portions of the holders 74-76 respectively. The rollers 77-79 are biased upward relative to the slider 72 by the springs 80-82 respectively.

The spring 82 upstream in the outward direction X from the springs 80 and 81 is greater in elastic force than them. The upstream spring 82 is positioned under the inlet 61.

The plate 73 has holes formed through it, through each of which one of the rollers 77-79 can shift vertically. The rollers 77-79 protrude above the plate 73 even when they are in their lowest positions. The rollers 77-79 support the waste toner box 60.

The plate 73 has a first limiter 83 and a second limiter 84, which limit the movement of the waste toner box 60 in the outward direction X and the opposite direction respectively while the inlet 61 is not connected to the outlet 39.

The first limiter 83 releasably limits the movement of the waste toner box 60 in the outward direction X relative to the plate 73. The first limiter 83 is positioned near the side of the roller 77 that is downstream in the outward direction X. The first limiter 83 consists of a stopper 83A and a coil spring 83B. The stopper 83A can move up and down and is biased upward relative to the plate 73 by the spring 83B so that the top of the stopper can normally be positioned above the bottom of the waste toner box 60. If the stopper 83A is pressed down against the force of the spring 83B, the box 60 can move in the outward direction X relative to the plate 73.

The second limiter 84 extends upward from the end of the plate 73 that is upstream in the outward direction X. The second limiter 84 limits the movement of the waste toner box 60 in the inward direction opposite to the direction X relative to the plate 73. While the slider 72 stops in the position shown in FIGS. 4 and 5, the second limiter 84 keeps the box 60 from moving in the inward direction beyond the position where the inlet 61 is connected to the outlet 39. The second limiter 84 limits the movement of the box 60 in the inward direction at the time when the box is put into the apparatus 100. The second limiter 84 makes it easy to position the box 60 when the inlet 61 is connected to the outlet 39.

FIGS. 6-8 show part of the process for taking the waste toner box 60 out of the apparatus 100.

Figure 6A:
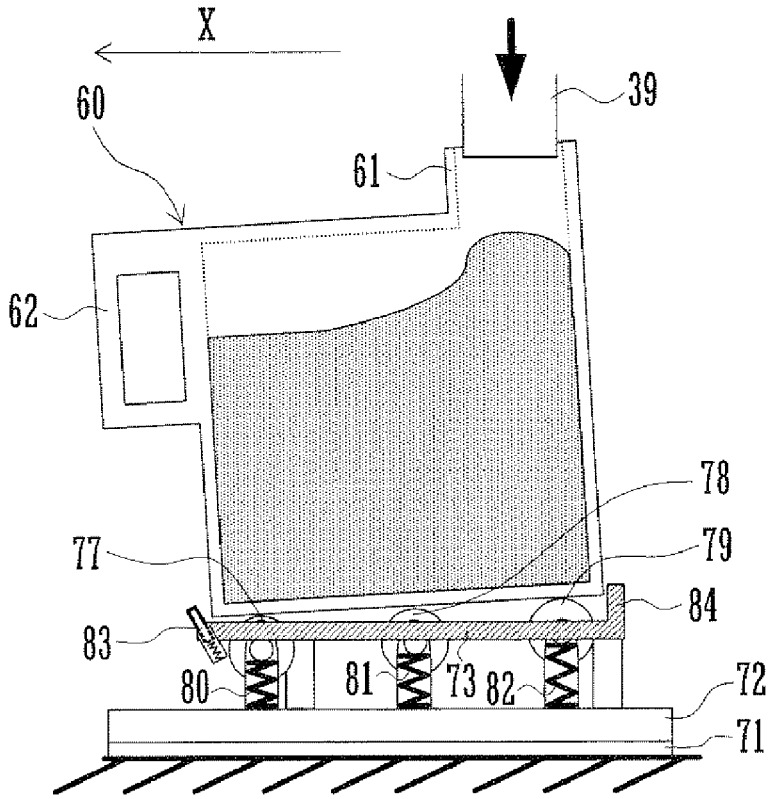
FIGS. 6-8 are sectional side views of part of the apparatus, showing part of the process for taking the waste toner box out of the apparatus.

As shown in FIG. 6A, waste toner is recovered into the waste toner box 60 through the inlet 61 connected to the outlet 39. The elastic force of the spring 82 upward biasing the roller 79 positioned under the inlet 61 is great enough to keep the inlet connected to the outlet 39 even when the box 60 is full of waste toner.

Because the inlet 61 is positioned at the end of the waste toner box 60 that is upstream in the outward direction X, and because the spring 82 upward biasing the roller 79 positioned under the inlet 61 is greater in elastic force than the springs 80 and 81, the box 60 tilts in this direction X as it is filled with waste toner.

The limiters 83 and 84 limit the movement of the waste toner box 60 in the outward and inward directions.

Figure 6B:
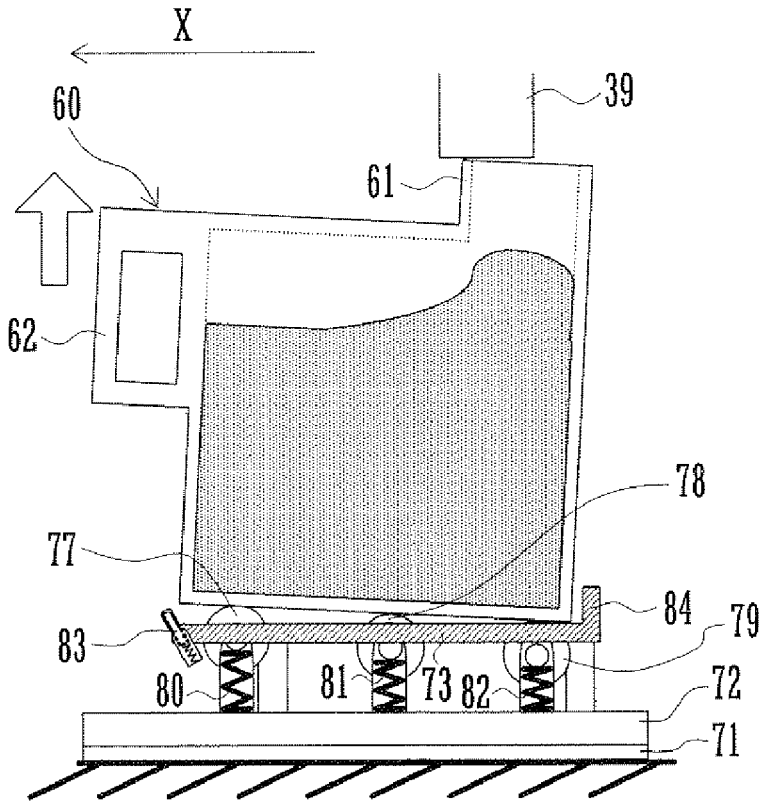

As shown in FIG. 6B, a user first raises the handle 62 to lower the end of the waste toner box 60 that is upstream in the outward direction X. This disconnects the inlet 61 from the outlet 39.

Figure 7A:
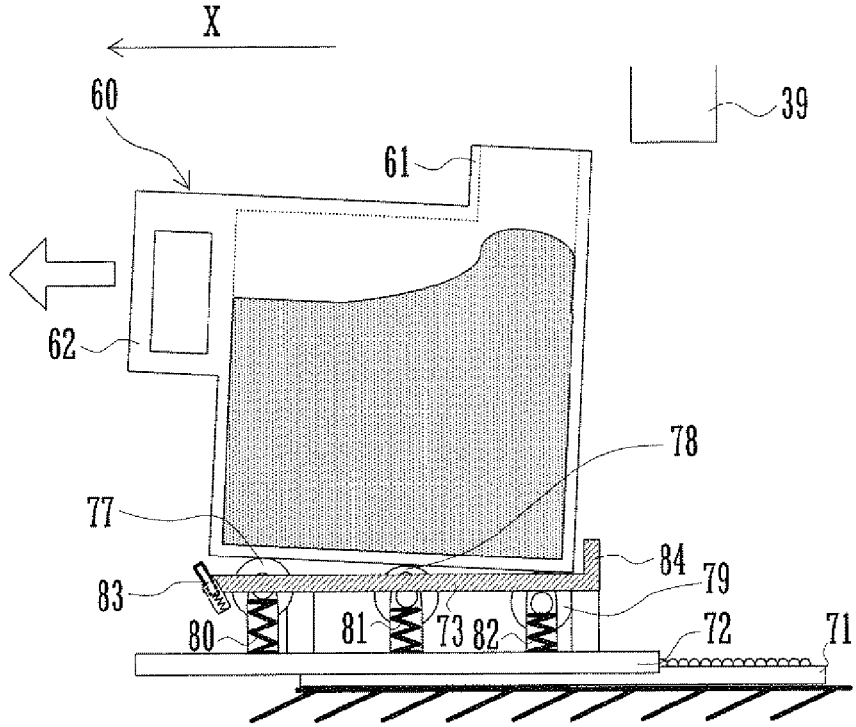
Figure 7B:
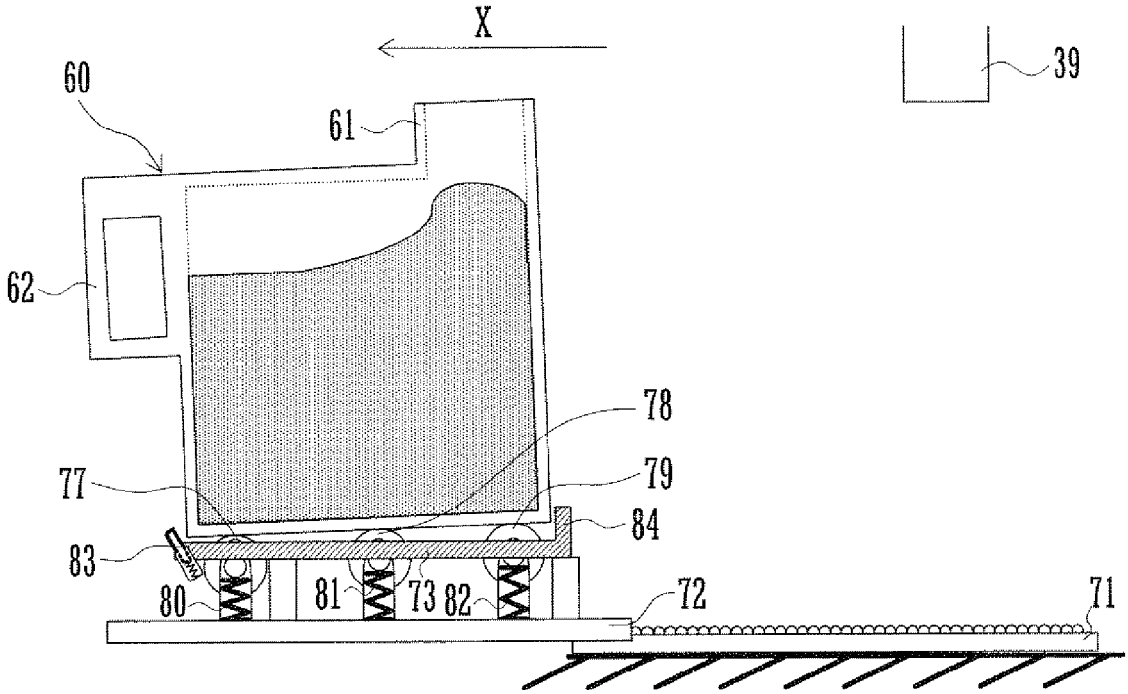

As shown in FIGS. 7A and 7B, the user subsequently pulls the handle 62 in the outward direction X to slide the slider 72 along the rail 71 in this direction until the waste toner box 60 comes near the front side of the apparatus body.

Figure 8A:
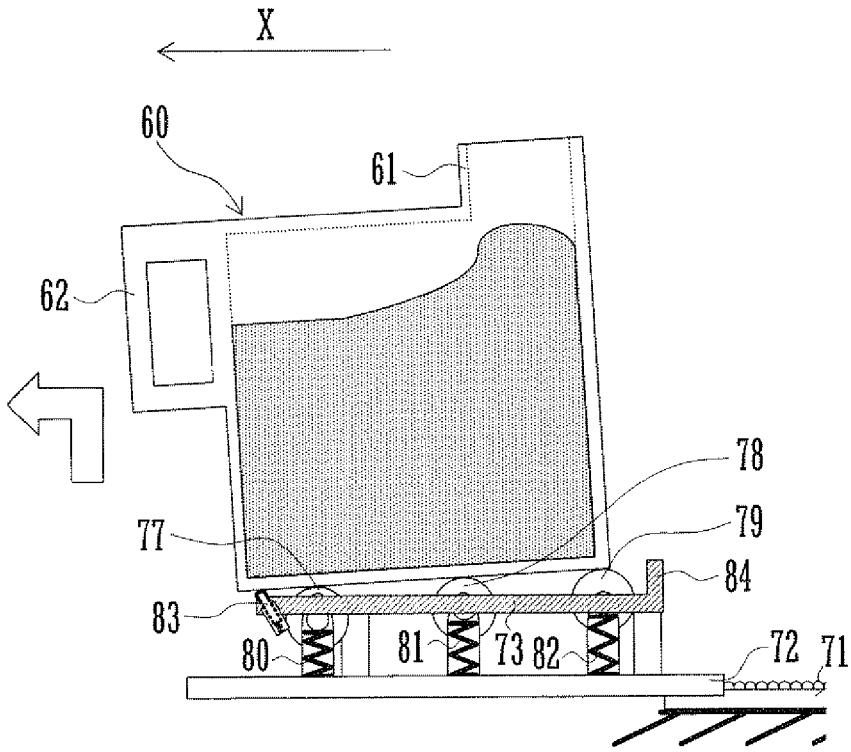
Figure 8B:
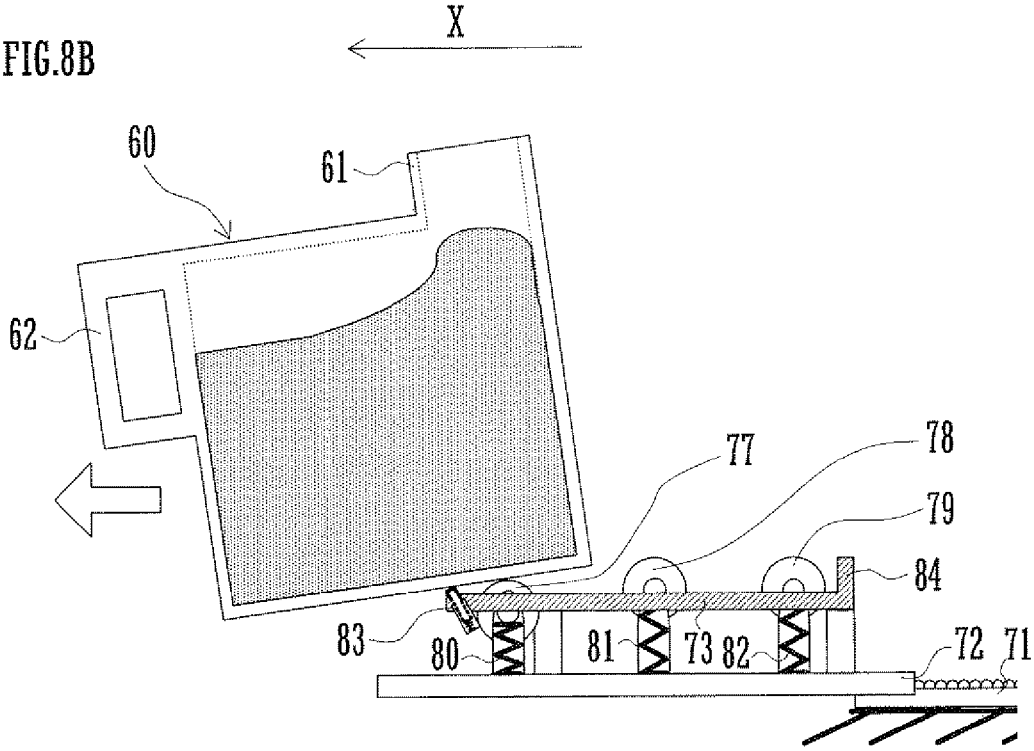

As shown in FIG. 8A, the user subsequently raises the handle 62 and pulls it in the outward direction X so that the waste toner box 60 can run onto the first limiter 83. When the box 60 runs onto the first limiter 83, the box 60 tilts in this direction X because the spring 82 is greater in elastic force than the springs 80 and 81. As shown in FIG. 8B, the user further pulls the handle 62 in this direction X to take the box 60 out of the apparatus body.

The waste toner box 60 can be taken out of the apparatus body with slight force, with the rollers 77-79 rotating.

As stated already, because the inlet 61 is positioned at the end of the waste toner box 60 that is upstream in the outward direction X, and because the spring 82 upward biasing the roller 79 positioned under the inlet 61 is greater in elastic force than the springs 80 and 81, the box 60 tilts in this direction when it is taken out of the apparatus body. This makes it possible to take out the box 60 with slighter force.

As a result, the waste toner box 60 is easy to take out. This improves the workability during the replacement of the box 60.

While the waste toner box 60 is in the apparatus body, the stabilizing members 63 and 64 are in compressive contact with the protrusions 68 and 69 respectively so as to be in the retracted positions. When the box 60 is taken out of the apparatus body, the stabilizing members 63 and 64 are brought out of contact with the protrusions 68 and 69 so that the elastic force of the springs 65 and 66 causes these members to pivot to the protruded positions. The stabilizing members 63 and 64 in the protruded positions prevent the box 60 from falling down. This prevents the toner in the box 60 from scattering.

When the waste toner box 60 is taken out of the apparatus body, the stabilizing members 63 and 64 pivot automatically from the retracted positions to the protruded positions. This further improves the workability during the replacement of the box 60.

It should be considered that the foregoing description of the embodiment is illustrative in all respects and not restrictive. The scope of the present invention is defined by the appended claims, not by the embodiment, and intended to include meanings equivalent to those of the elements of the claims and all modifications in the claims.

What is claimed is:

1. An apparatus for image formation that recovers toner remaining on an image carrier and conveys the recovered toner to an outlet, the apparatus comprising:

a main body;

a slider supported by the main body and capable of reciprocating in the outward direction from the inside of the body to one side of the body and the inward direction opposite to the outward direction;

a plurality of rotatable members arranged in the outward and inward directions over the slider;

elastic members each biasing one of the rotatable members upward relative to the slider; and a waste toner box adapted to be supported on the rotatable members;

the waste toner box having an inlet formed at the end thereof upstream in the outward direction for connection to the bottom of the outlet;

wherein the elastic member most upstream of all the elastic members in the outward direction is the greatest in biasing force of all the elastic members.

2. An apparatus for image formation as claimed in claim 1, wherein the slider has a first limiter for releasably limiting the movement of the waste toner box in the outward direction relative to the slider.

3. An apparatus for image formation as claimed in claim 1, wherein the slider has a second limiter for limiting the movement of the waste toner box in the inward direction beyond the position where the inlet is connected to the outlet.

4. An apparatus for image formation as claimed in claim 1, wherein the waste toner box has a stabilizing member fitted to the bottom thereof, the stabilizing member being shiftable between a protruded position where the stabilizing member is protruded from the box bottom perpendicularly to the outward and inward directions and a retracted position where the stabilizing member is retracted within the box bottom.

5. An apparatus for image formation as claimed in claim 4, further comprising:

a shifting member for positioning the stabilizing member in the retracted position when the waste toner box is positioned in the main body;

the waste toner box further having a biasing member fitted thereto for shifting the stabilizing member from the retracted position to the protruded position when the box is taken out of the main body.

* * * * *